US006309288B1

(12) United States Patent
Chung

(10) Patent No.: US 6,309,288 B1
(45) **Date of Patent: *Oct. 30, 2001**

(54) RETARDING MECHANISM FOR A GRINDING MACHINE

(76) Inventor: Lee Hsin-Chih Chung, No. 21-8, Shang San Cho Woo, Wuchang-Li, Chungli-City, Tao Yuan Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/507,798

(22) Filed: Feb. 22, 2000

(51) Int. Cl.[7] ..... B24B 23/00
(52) U.S. Cl. ..... 451/359; 451/360; 451/344
(58) Field of Search ..... 451/347, 359, 451/353, 357

(56) References Cited

U.S. PATENT DOCUMENTS 6,110,028 * 8/2000 Chung ..... 451/359

FOREIGN PATENT DOCUMENTS 374344 11/1999 (CN) .

* cited by examiner

*Primary Examiner*—Joseph J. Hail, III
*Assistant Examiner*—Daniel Shanley
(74) *Attorney, Agent, or Firm*—Ostrolenk, Faber, Gerb & Soffen, LLP

(57) ABSTRACT

A retarding mechanism for a grinding machine which is an improvement on a prior patent application, and comprises a body and a grinding member. Wherein, the body is fixedly provided with an annular plane plate encircling an output axle thereof, the grinding member is fixedly provided with a fixing seat on the rear surface thereof, the retarding mechanism is characterized by that: the fixing seat is provided with a plurality of peripheral abrasive members which are arciform raised portions to render the abrasive members more solid and resistive to grinding and contactable with the plane plate in larger area. Therefore, during rotation of the grinding member, the abrasive members can provide a better structure to get larger friction force with the plane plate to endue the grinding member with a desired retarding effect.

3 Claims, 3 Drawing Sheets

RETARDING MECHANISM FOR A GRINDING MACHINE

FIELD OF THE INVENTION

The present invention is related to a retarding mechanism for a grinding machine, and especially to an effective improved structure on a prior retarding mechanism for a grinding machine; wherein, speed-reducing action of the grinding member can be more stable when in rotating. With this, cost of production, weight of the whole grinder as well as processes of assembling can all be reduced.

BACKGROUND OF THE INVENTION

The present invention is an improvement on a retarding mechanism for a grinding machine of a prior patent application (with a filing number: R.O.C. Application No. 87220682). The retarding mechanism for the grinding machine of the prior patent application includes a body, a plane plate, a grinding member and a plurality of abrasive members. Wherein, the body is provided therein with a motor of which a driving axle combines with an output axle, the output axle extends out of the body and can be driven by the driving axle of the motor for rotation. The body encircling the output axle is fixedly provided with an annular plane plate. The grinding member is fixedly provided with a fixing seat on the rear surface thereof by means of screws, and with a grinding tool on the front surface thereof. The fixing seat is provided on the periphery thereof with a plurality of grooves which each has a through hole on the bottom thereof. The abrasive members are made of material with low friction coefficient (such as Teflon, plastic etc.) The abrasive members are bending strips each with a width to be exactly receivable in the grooves. One end of each abrasive member has a through hole. The mode of combination of the abrasive members with the fixing seat is: one end of each abrasive member is received in one of the grooves to have two corresponding through holes aligned with each other, then a screw is extended through the two holes, and a nut is locked on the screw to fix the abrasive member in the groove. When the grinding member is assembled on the output axle extending out of the body, the bending protruding portion of the abrasive member contacts and presses the plane plate appropriately. In the mean time, if the grinding member is driven for rotating, the abrasive member will be rotated therewith, and friction force will be induced between the abrasive member and the plane plate to slow down the rotation speed of the grinding member.

However, the bending protruding portion of the abrasive member is structurally elastic, when elasticity thereof is weakened, the abrasive member tends to deviate; and height of the protruding portion is unable to be controlled, so friction force between the abrasive member and the plane plate can not be large, and can not effectively slow down the rotation speed of the grinding member. In view of this, the present invention provides improvement on the existed defect in speed reducing of the prior retarding mechanism for a grinding machine.

SUMMARY OF THE INVENTION

The present invention has a main object to provide a retarding mechanism for a grinding machine, wherein, the abrasive members are improved to have a more stable structure and have a broader contact area with the plane plate. So that when the grinding member rotates, the abrasive members can provide a better structure and larger friction force to retard the grinding member.

The present invention has another object to provide a retarding mechanism for a grinding machine, wherein, the abrasive members are arciform raised portions rather than bending strips. In this way, cost of production of the retarding mechanism can be lowered to be economic.

Another object of the present invention is to provide a retarding mechanism for a grinding machine, wherein, the abrasive members in the form of arciform raised portions are integrally molded with the fixing seat, assembling process of the present invention can thus be more convenient than that of the prior retarding mechanism for a grinding machine.

The retarding mechanism for a grinding machine of the present invention includes a body and a grinding member, the body is provided with an annular plane plate encircling an output axle, and the grinding member is fixedly provided with a fixing seat on the rear surface thereof. The retarding mechanism is characterized by that: the fixing seat is provided with a plurality of peripheral arciform raised portions to render the abrasive members thereof more solid and resistive to grinding and contactable with the plane plate in larger area. Therefore, during rotation of the grinding member, the abrasive members can provide a better structure to get larger friction force with the plane plate to endue the grinding member with a desired retarding effect.

The present invention will be apparent in the objects and functions after reading the detailed description of the preferred embodiment thereof in reference to the accompanying drawings.

DETAILED DESCRIPTION OF THE PREFERRED EMBODIMENT

Figure 1:
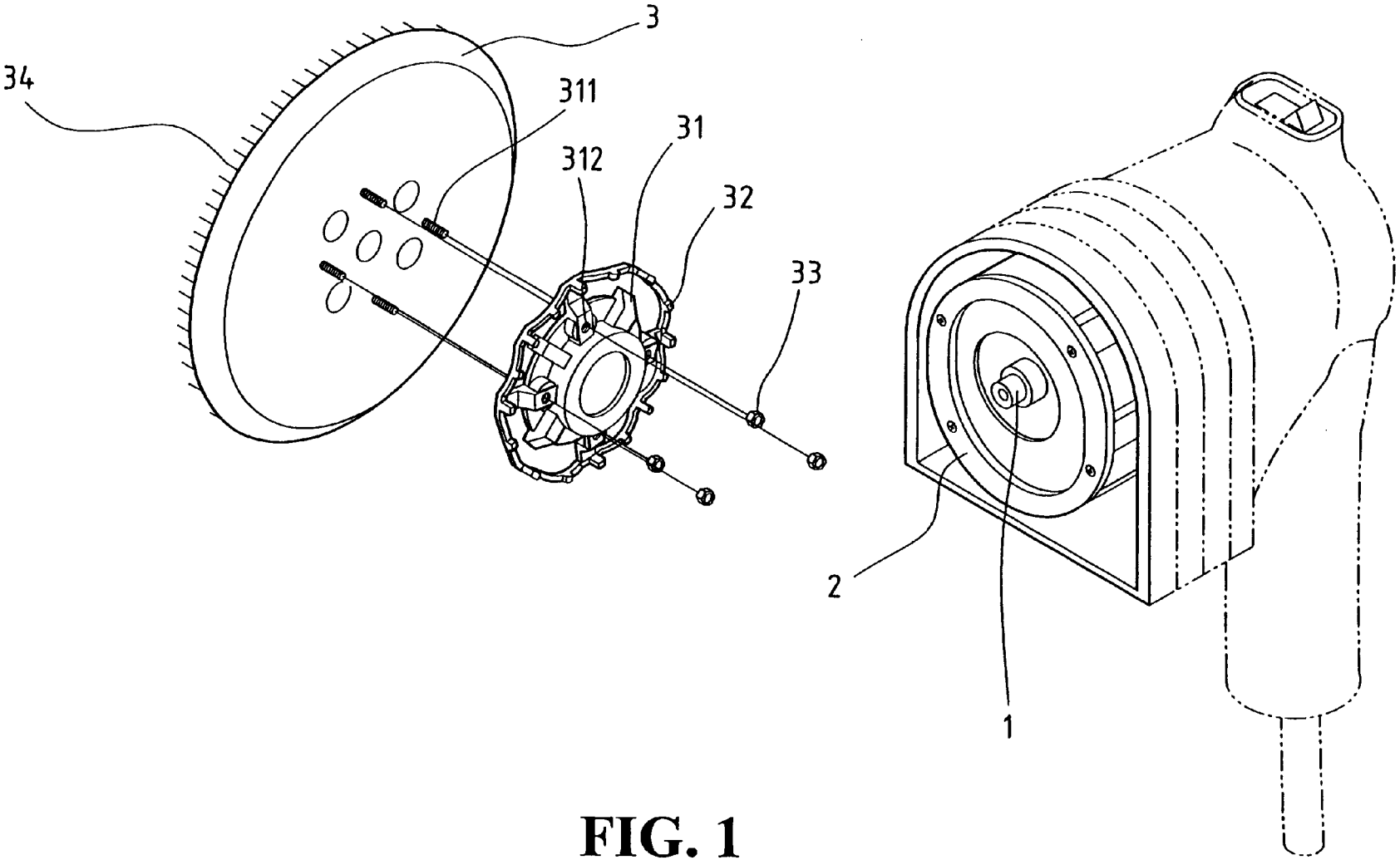
FIG. 1 is an analytic perspective view showing the retarding mechanism of the present invention.
Figure 2:
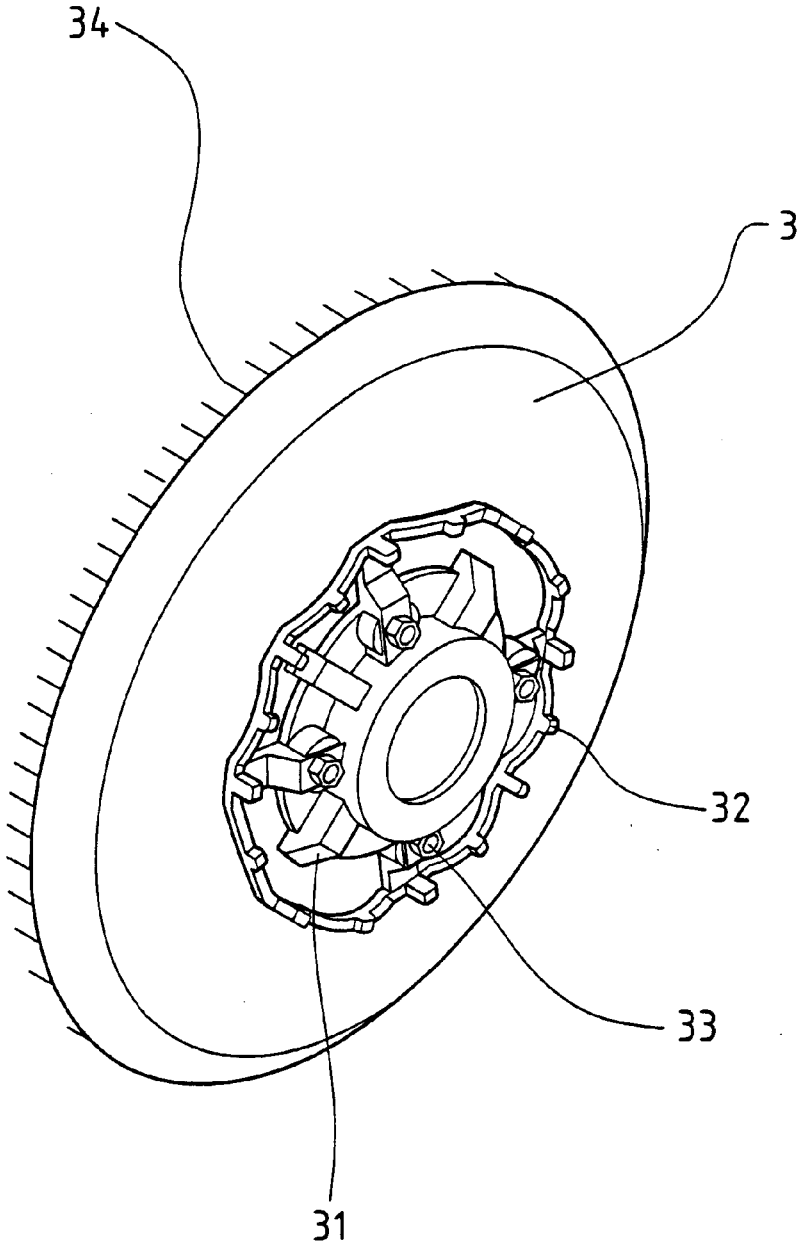
FIG. 2 is a perspective view showing the grinding member and the fixing seat of the present invention after assembling.
Figure 3:
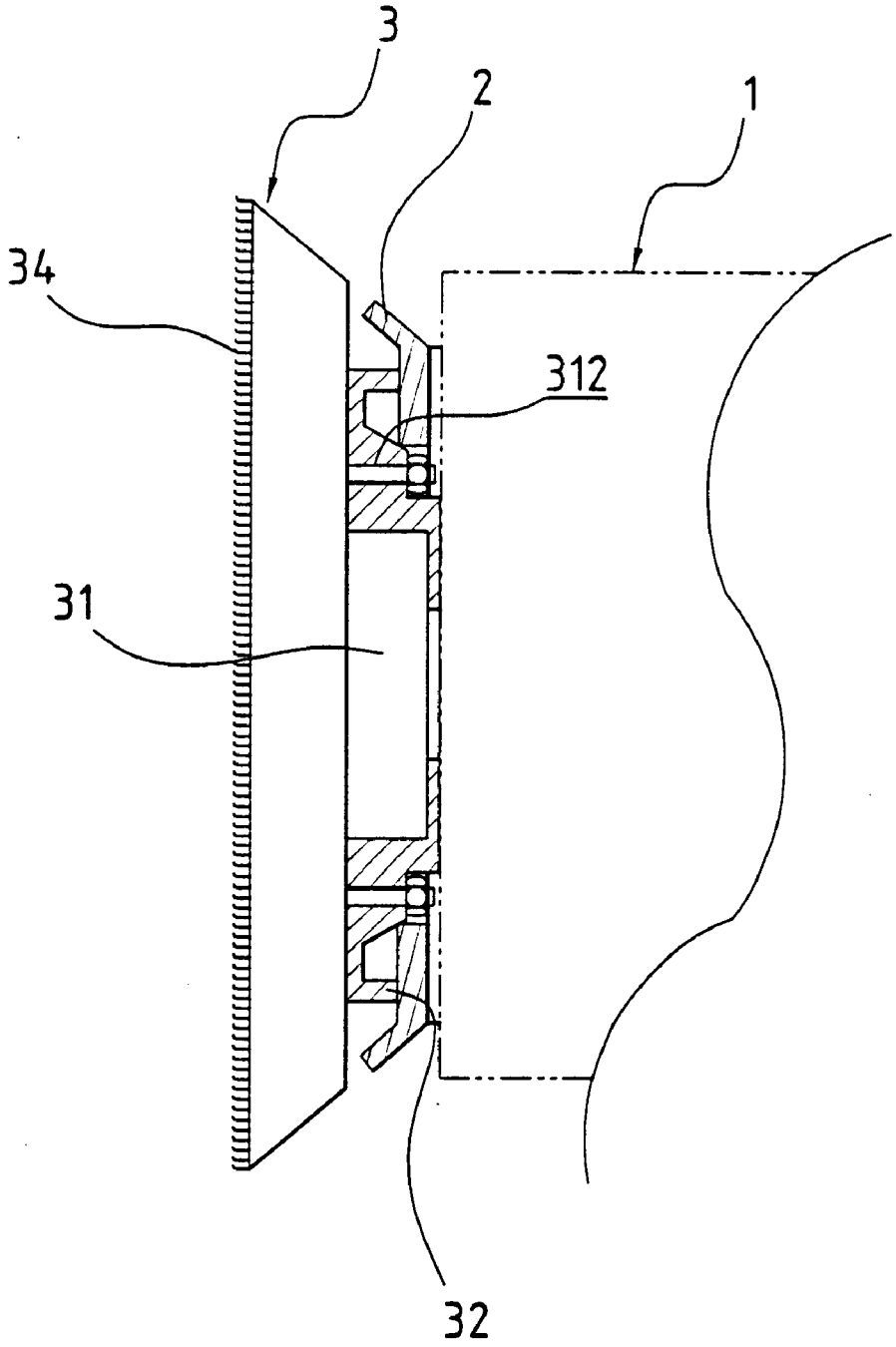
FIG. 3 is a sectional view of the retarding mechanism of the present invention.

Referring to FIGS. 1 to 3, the retarding mechanism for a grinding machine of the present invention is comprised of a body 1, a plane plate 2, a grinding member 3 and a plurality of abrasive members 32. Wherein, the body 1 is provided therein with a motor of which a driving axle combines with an output axle 11, the output axle 11 extends out of the body 1 and can be driven by the driving axle of the motor for rotation. The body 1 encircles the output axle 11 and is fixedly provided with an annular plane plate 2 with a smooth plane surface. The grinding member 3 is fixedly provided with a fixing seat 31 on the rear surface thereof by means of screws, and with a grinding tool 34 on the front surface thereof. The grinding tool 34 is preferably a sand cloth. The fixing seat 31 is provided on the periphery thereof with a plurality of holes 312. The abrasive members 32 are made of material preferably with low friction coefficient (such as Teflon, plastic etc.). The abrasive members 32 are peripheral arciform raised portions encircling the fixing seat 31, and are integrally formed with the latter. The grinding member 3 is provided on the rear surface thereof with a plurality of screws 311 which extend through the holes 312 and are locked with nuts 33 respectively to fix the fixing seat 31 on the rear surface of the grinding member 3.

With the above stated structure of the present invention, when the grinding member 3 is assembled on the output axle

11 extending out of the body 1, the arciform raised portions of the abrasive members 32 contact and press the plane plate 2 broadly; if the grinding member 3 is rotated now, the abrasive members 32 will be rotated therewith, and friction force will be generated between the abrasive members 32 and the plane plate 2 to slow down the rotation speed of the grinding member 3. And with the improved structure of the present invention with the stated abrasive members, the present invention is more structurally strong and durable and is provided with better frictional effect, and processes required in assembling are reduced, it is therefore an invention with practicality and improvement.

The aforesaid is only for illustrating a preferred embodiment of the present invention, and not for giving any formal limitation to the scope of the present invention. It will be apparent to those skilled in this art that various modifications or changes can be made to the elements of the present invention without departing from the spirit, scope and characteristic of this invention. Accordingly, all such modifications and changes also fall within the scope of the appended claims and are intended to form part of this invention.

What is claimed is:

1. A retarding mechanism for a grinding machine comprising a body and a grinding member, wherein, said grinding member combines with an output axle extending out of said body, said output axle is driven by a motor for rotation, said body encircles said output axle and is fixedly provided with an annular plane plate, said retarding mechanism is characterized by that:

said grinding member is fixedly provided with a fixing seat on the rear surface thereof, said fixing seat is provided with a plurality of peripheral abrasive members, in order that said abrasive members contacts said plane plate when said grinding member combines with said output axle.

2. A retarding mechanism for a grinding machine as claimed in claim 1, wherein, said abrasive members are a plurality of peripheral arciform raised portions which contact said plane plate to reduce rotating speed of said grinding member.

3. A retarding mechanism for a grinding machine as claimed in claim 1, wherein, said grinding member is provided on the rear surface thereof with a plurality of screws, said fixing seat is provided on the periphery thereof with a plurality of holes, said screws extend through said holes and are locked with nuts respectively to fix said fixing seat on the rear surface of said grinding member.

* * * * *